US006302739B1

(12) United States Patent
Deno et al.

(10) Patent No.: US 6,302,739 B1
(45) Date of Patent: Oct. 16, 2001

(54) ELECTRO MAGNETIC SHIELD CONNECTOR

(75) Inventors: Masahiro Deno; Mitsuhiro Matsumoto, both of Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/377,818

(22) Filed: Aug. 20, 1999

(30) Foreign Application Priority Data

Sep. 18, 1998 (JP) ..... 10-264879

(51) Int. Cl.[7] ..... H01R 13/648
(52) U.S. Cl. ..... 439/609; 439/939
(58) Field of Search ..... 439/578, 607, 439/609, 843, 845, 939

(56) References Cited

U.S. PATENT DOCUMENTS 3,614,717 * 10/1971 Boersma ..... 339/262
3,924,922 * 12/1975 DeCenzo ..... 339/259
4,099,825 * 7/1978 Jackson ..... 339/177
4,426,127 * 1/1984 Kubota ..... 339/177
5,052,948 * 10/1991 Hyzin ..... 439/607
5,195,902 * 3/1993 Bengal ..... 439/188
5,322,459 * 6/1994 Spinnato ..... 439/843
5,328,393 * 7/1994 Perret et al. ..... 439/843
5,810,620 * 9/1998 Kobayashi et al. ..... 439/610

FOREIGN PATENT DOCUMENTS 5-1182 1/1993 (JP) .

* cited by examiner

*Primary Examiner*—Brian Sircus
*Assistant Examiner*—Thanh-Tam Le
(74) *Attorney, Agent, or Firm*—Finnegan, Henderson, Farabow, Garrett & Dunner, L.L.P.

(57) ABSTRACT

An electro magnetic shield connector includes: a connector housing formed with a connector insertion chamber; a shield shell provided in the connector insertion chamber having a plurality of terminal contact spring pieces; a mated connector housing having an insertion section; and another shield shell provided in the mated connector housing. In the construction, when the insertion section of the mated connector housing is inserted into the connector insertion chamber of the connector housing, the terminal contact spring pieces of the shield shell are elastically deformed so as to come in contact with the another shield shell provided in the mated connector housing. Furthermore, the plural terminal contact spring pieces are composed of plural wider terminal contact spring pieces and plural narrower terminal contact spring pieces.

4 Claims, 11 Drawing Sheets

ELECTRO MAGNETIC SHIELD CONNECTOR

BACKGROUND OF THE INVENTION

1. Field of the Invention

The present invention relates to an electro magnetic shield connector having a shield shell made of conductive metal for cover circumferences of a pair of male and female connecting terminals fitted into each other so as to electro-magnetically shield them.

2. Description of Relevant Art

As such an electro magnetic shield connector In the relevant art, there exists an electro magnetic shield connector which is includes a shield shell made of conductive metal for cover circumferences of a male and female connecting terminals fitted into each other. According to the construction, wire is electro-magnetically shielded.

However, faulty contact occurs in the electro magnetic shield connector. In addition, insertion operation can hardly be performed in a normal insertion position smoothly and easily. Furthermore, the shield shell can hardly be electrically connected with a case securely. Therefore, waterproofness of the electro magnetic shield connector in the relevant art is hardly improved.

SUMMARY OF THE INVENTION

The present invention has been achieved with such points in mind.

It therefore is an object of the present invention to provide an electro magnetic shield connector that even if a diameter of an insertion section of a mated connector scatters, faulty contact does not occur.

To achieve the object, according to a first aspect of the present invention, there is provided an electro magnetic shield connector comprising: a connector housing to be mounted to a case of an electrical equipment, a connector insertion chamber being formed inside the connector housing; a shield shell provided in the connector insertion chamber of the connector housing, the shield shell having a plurality of terminal contact spring pieces; a mated connector housing having an insertion section to be inserted into the connector insertion chamber; and another shield shell provided in the mated connector housing, wherein when the insertion section of the mated connector housing is inserted into the connector insertion chamber of the connector housing, the terminal contact spring pieces of the shield shell are elastically deformed so as to come in contact with the another shield shell provided in the mated connector housing; and the plural terminal contact spring pieces are composed of plural wider terminal contact spring pieces and plural narrower terminal contact spring pieces.

In the construction according to the first aspect, the wider terminal contact spring pieces and the narrower terminal contact spring pieces have different allowable stresses, and the terminal contact spring pieces with a larger diameter are inserted as the insertion section of the mated connector housing. Even if the wider terminal contact spring pieces function defectively due to excessive displacement, the narrower terminal contact spring pieces do not function defectively. As a result, faulty contact does not occur.

According to a second aspect of the present invention, as it depends from the first aspect, there is provided a electro magnetic shield connector wherein, the shield shell is formed into a cylindrical shape; the plural terminal contact spring pieces are provided on a peripheral direction of the cylindrical shape of the shield shell; the plural wider terminal contact spring pieces are arranged on a cylindrical portion of the shield shell so as to face each other; and the plural narrower terminal contact spring pieces are arranged on the cylindrical portion of the shield shell so as to face each other.

In the construction according to the second aspect, since spring forces are applied to the insertion section of the mated connector housing in a balanced state, the insertion operation can be performed in a normal insertion position smoothly and easily.

According to a third aspect of the present invention, as it depends from the first or the second aspect, there is provided an electro magnetic shield connector further comprising: case contact pieces provided on the shield shell, wherein when the connector housing is inserted into a connector insertion hole formed on the case of the electrical equipment, the case contact pieces are elastically deformed so as to come in contact with an inner surface of the connector insertion hole.

In the construction according to the third aspect, even if the mounting seat section is deformed due to a heat, the shield shell can be electrically connected with the case securely.

According to a fourth aspect of the present invention, as it depends from the first, second or third aspect, there is provided an electro magnetic shield connector further comprising: a mounting seat section which is composed integrally with the connector housing, the mounting seat section has a flange shape, the mounting seat section having a case contact surface to come in contact with the case of the electrical equipment, wherein bolt insertion through holes, into which bolts are inserted in order to mount the connector housing to the case of the electrical equipment, are formed in the mounting seat section; a seal groove, in which a sealing member for sealing the case of the electrical equipment and the case contact surface is inserted, is formed on the case contact surface of the mounting seat section; and the bolts are inserted through the bolt insertion through holes and the mounting seat section is fastened to the case of the electrical equipment so that the sealing member seals the case of the electrical equipment and the case contact surface.

In the construction according to the fourth aspect, since the sealing member (sealing ring) intervenes between the sealing connector and the case due to fastening force of the bolts, waterproofness becomes very high.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1A:
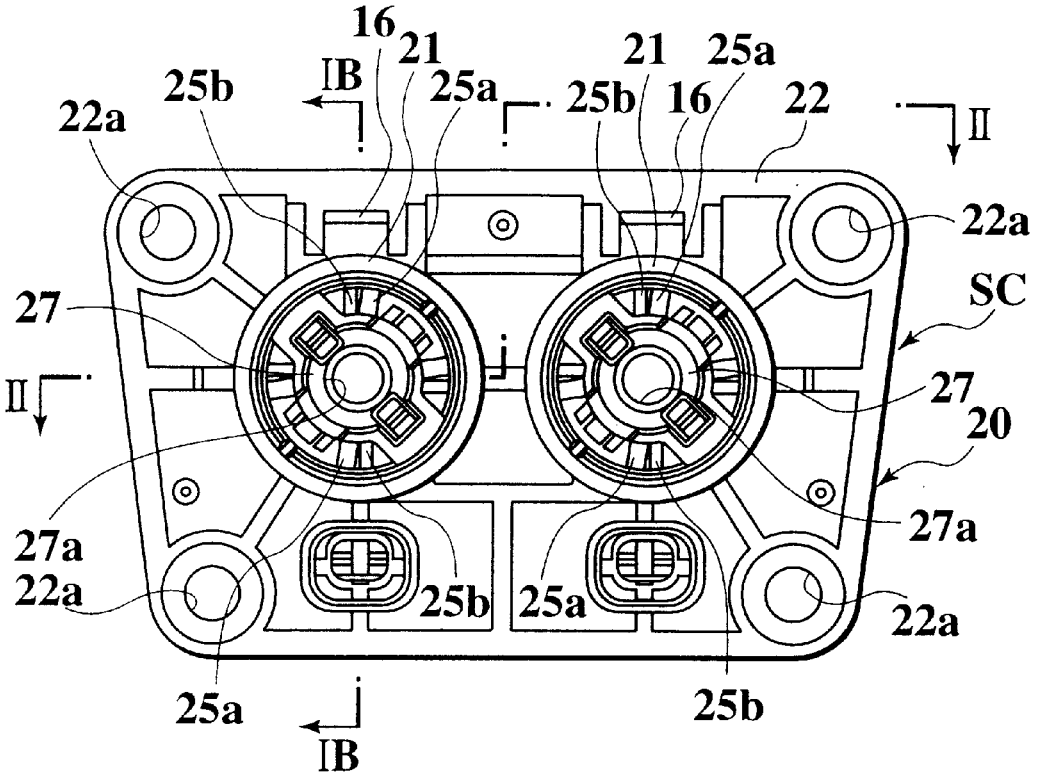
FIG. 1A is a front view of an electro magnetic shield connector according to a second embodiment of the present invention.

There will be detailed below the preferred embodiments of the present invention with reference to the accompanying drawings. Like members are designated by like reference characters.

FIGS. 10 through FIGS. 14 show an electro magnetic shield connector which is filed in the Japanese Patent Office (Japanese Patent Application No. 9-288775). The Japanese Patent Application No. 9-288775 had not yet been laid-open at the priority date of this United States Application, Sep. 18, 1998.

Referring now to FIGS. 10 through 14, an electro magnetic shield connector according to a first embodiment will be explained hereinbelow.

In FIGS. 10 through 14, a resin-made connector main body 1 is composed integrally of twin approximately cylindrical connector housings 2 and a mounting seat section 3 for connecting the connector housings 2 with each other. A hole 2*a* which opens on both surfaces is formed in the connector housings 2 in its axial direction, and a shield shell 4 made of conductive metal is provided in the hole 2*a*. The shield shell 4 is formed by two members into an approximately cylindrical shape and are arranged so as to come in contact with an inner surface of the hole 2*a*. A plurality of case contact pieces 4*a* are formed at one end side of the shield shell 4 in a peripheral direction by bending. The case contact pieces 4*a* are projected outside from one end of the connector housing 2. Moreover, a plurality of terminal contact spring pieces 4*b* are provided at the other end side of the shield shell 4 on its peripheral surface. The other end side of the holes 2*a* including the portions, where the plural terminal contact spring pieces 4*b* were provided, composes a connector insertion chamber 5.

An inner housing member 6 has an approximately cylindrical shape, and is fixed to an inner peripheral side of the shield shell 4 at the one end side of the hole 2*a*. A hole 6*a* which opens on both the surfaces is formed in the inner housing member 6 in its axial direction, and a pin terminal 7 is mounted to the hole 6*a*. An insertion point side of the pin terminal 7 is arranged in a center position of the connector insertion chamber 5, and an insertion backward end of the pin terminal 7 is connected with an end of a covered electric wire (electric wire) 8. Moreover, the one end side of the inner housing member 6 is provided with a pair of holder engagement pieces 6*b* which are projected further than the case contact pieces 4*a*, and the paired holder engagement pieces 6*b* are engaged with engagement grooves 10*c* of a holder 10. Here, a reference numeral 9 in the drawings is a seal ring.

Bolt insertion holes 3*a* are formed respectively at four corners of the mounting seat section 3, and bolts which are inserted through the bolt insertion holes 3*a* are fitted into a case 11 of an electrical equipment so that the electro magnetic shield connector is fixed to the case 11.

The holder 10 is formed with an electric wire insertion hole 10*a* in its center, and the electric wire 8 is inserted into the electric wire insertion hole 10*a*. A plurality of projections 10*b* are provided on one end side of the holder 10, and a pair of engagement grooves 10*c* are provided in the holder 10. The holder 10 is mounted in such a manner that the projections 10*b* are arranged between the case contact pieces 4*a* and the holder engagement pieces 6*b* of the inner housing member 6 are engaged respectively with the engagement grooves 10*c*.

The case of the electrical equipment is formed by a conductive metallic member, and connector insertion holes 11*a* are formed in the case 11. One end of the connector housing 2 is inserted into the connector insertion holes 11*a*.

Figure 12:
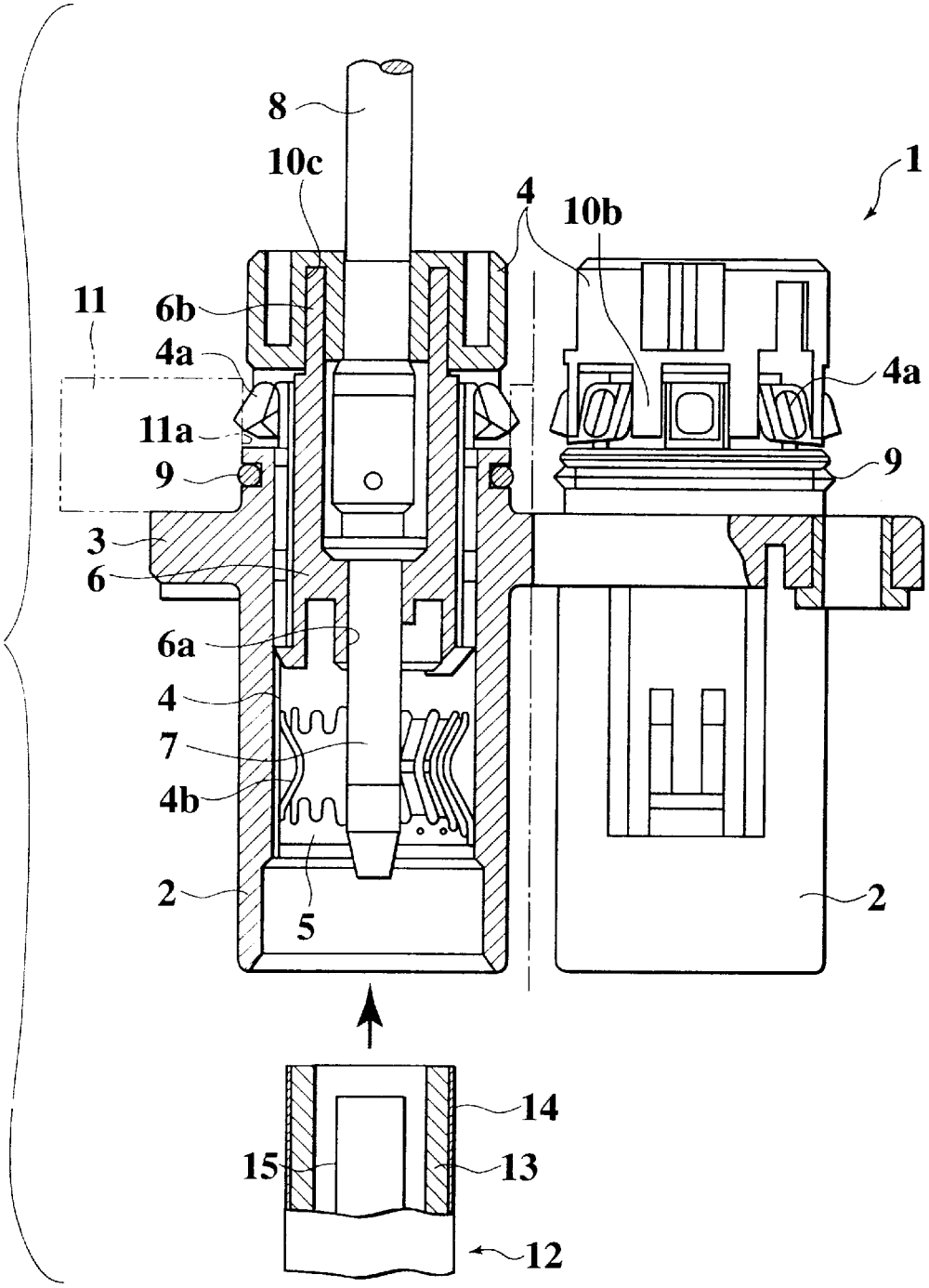
FIG. 12 is a sectional view taken along line XII—XII of FIG. 10.
Figure 13:
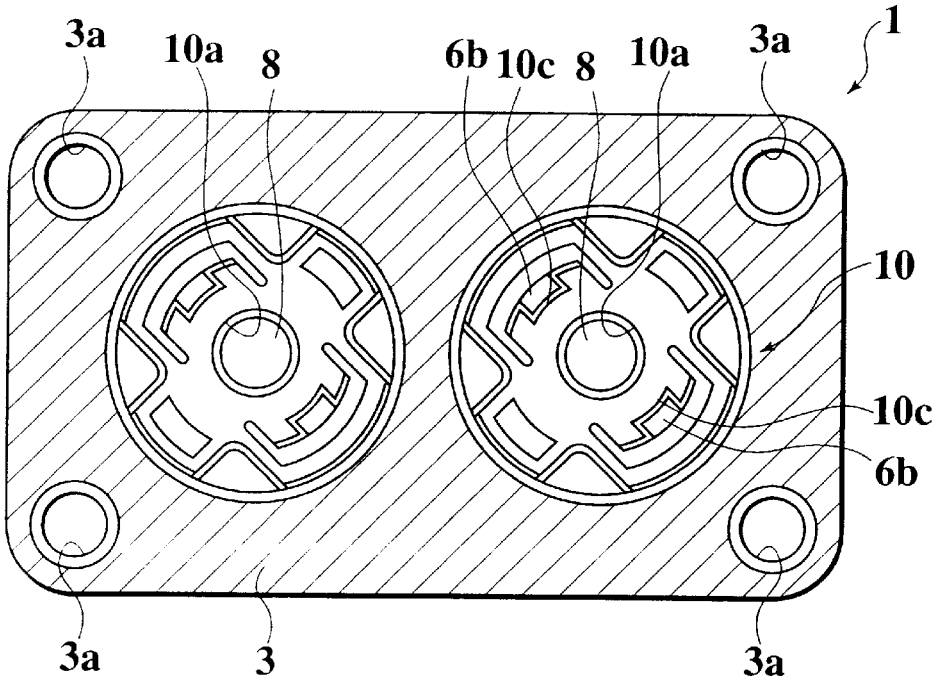
FIG. 13 is a rear view of the electro magnetic shield connector according to the first embodiment of the present invention.
Figure 14:
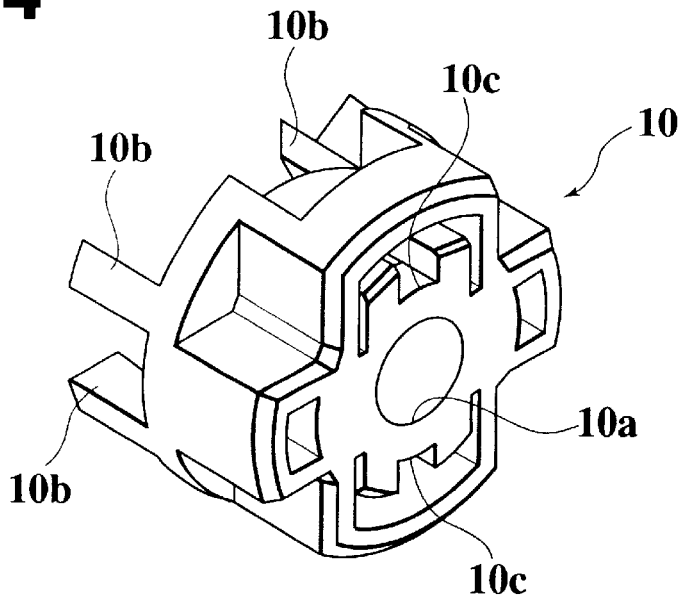
FIG. 14 is a perspective view of a holder according to the first embodiment of the present invention.

As shown in FIG. 12, a mated connector 12 is constituted so that its insertion section 13 of the connector housing has a cylindrical shape, and a cylindrical shield shell 14 is provided on an outer periphery of the insertion section 13. Moreover, a female terminal 15 is provided inside the insertion section 13. In the insertion position, the shield shell 14 of the mated connector 12 comes in contact with the contact spring pieces 4*b* of the shield shell 4 of the connector housing 2, and the female terminal 15 comes in contact with the pin terminal 7. Here, a shield electric wire, not shown, is mounted to the mated connector 12 via a shield terminal, not shown.

The following will describe the steps of mounting the electro magnetic shield connector. At first, the pin terminal 7 connected with the electric wire 8 is inserted through the electric wire insertion hole 10*a* of the holder 10. Meanwhile, the one end of the connector housing 2 is inserted through the connector insertion hole 11*a* of the case 11 of the electrical equipment, and the mounting seat section 3 is brought into contact with the case 11. The plural case contact pieces 4*a* are elastically deformed at the insertion step so as to be inserted into the connector insertion holes 11*a*, and the plural case contact pieces 4*a* are brought into contact with the case 11 by elastic force. Next, the pin terminal 7 is inserted into the hole 6*a* of the inner housing member 6, and the holder engagement pieces 6*b* of the inner housing member 6 are engaged with the engagement groove 10*a* of the holder 10 so that the holder 10 is mounted. Next, bolts (not shown) are inserted respectively into the bolt insertion holes 3*a* of the mounting seat section 3, and the bolt are fitted into the case 11 so that the connector main body 1 is fixed to the case 11 finally.

The connection between the connectors is obtained by inserting the insertion section 13 of the connector main body of the mated connector 12 into the connector insertion chamber 5 of the electro magnetic shield connector. In this insertion step, the terminal contact spring pieces 4*b* of the shield shell 4 of the connector housing 2 are elastically deformed in a diameter-enlarged direction so that the shield shell 14 of the mated connector 12 is allowed to be inserted. Moreover, the pin terminal 7 is inserted into the female terminal 15. As a result, the plural terminal contact spring pieces 4*b* are electrically connected with the shield shell 14 of the mated connector 12, and the pin terminal 7 is electrically connected with the female terminal 15.

However, in the above-mentioned electro magnetic shield connector, since the terminal contact spring pieces 4*b* of the shield shell 4 of the connector housing 2 are brought into contact with the shield shell 14 of the mated connector 12 by elastically deforming the terminal contact spring pieces 4*b*, there is possibility that the contact state scatters due to scattering of a diameter of the insertion section 13 of the mated connector 12. Namely, when the dimensions of the terminal contact spring pieces 4*b* are uniform, allowable stresses of the springs are uniform. For this reason, the insertion section 13 which has a diameter such that excessive deformation occurs is inserted, all the terminal contact spring pieces 4*b* are deformed uniformly.

In this connection, the electro magnetic shield connector described above is further improved as the electro magnetic shield connector which is described hereinbelow, as a second embodiment according to the present invention.

Figure 1B:
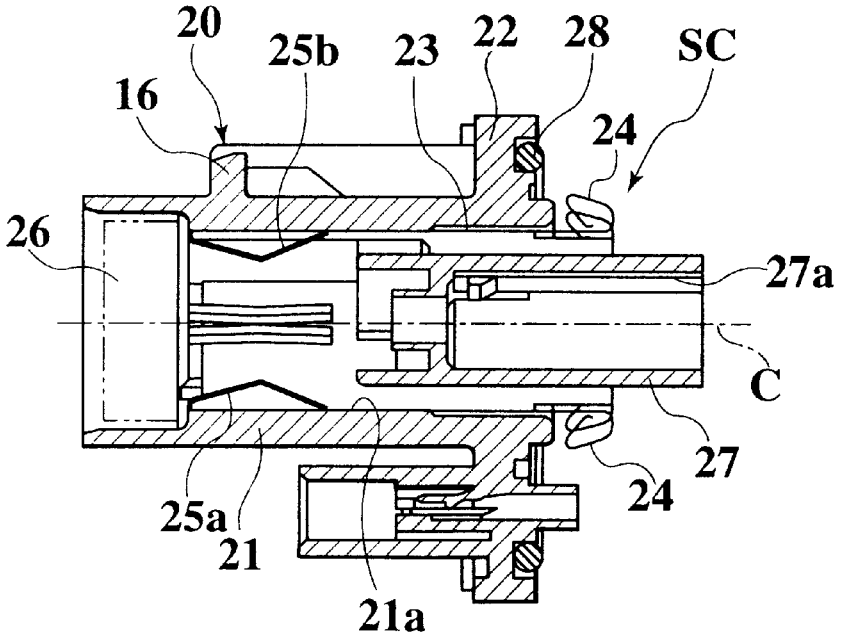
FIG. 1B is a sectional view taken along line IB—IB of FIG. 1A.
Figure 2:
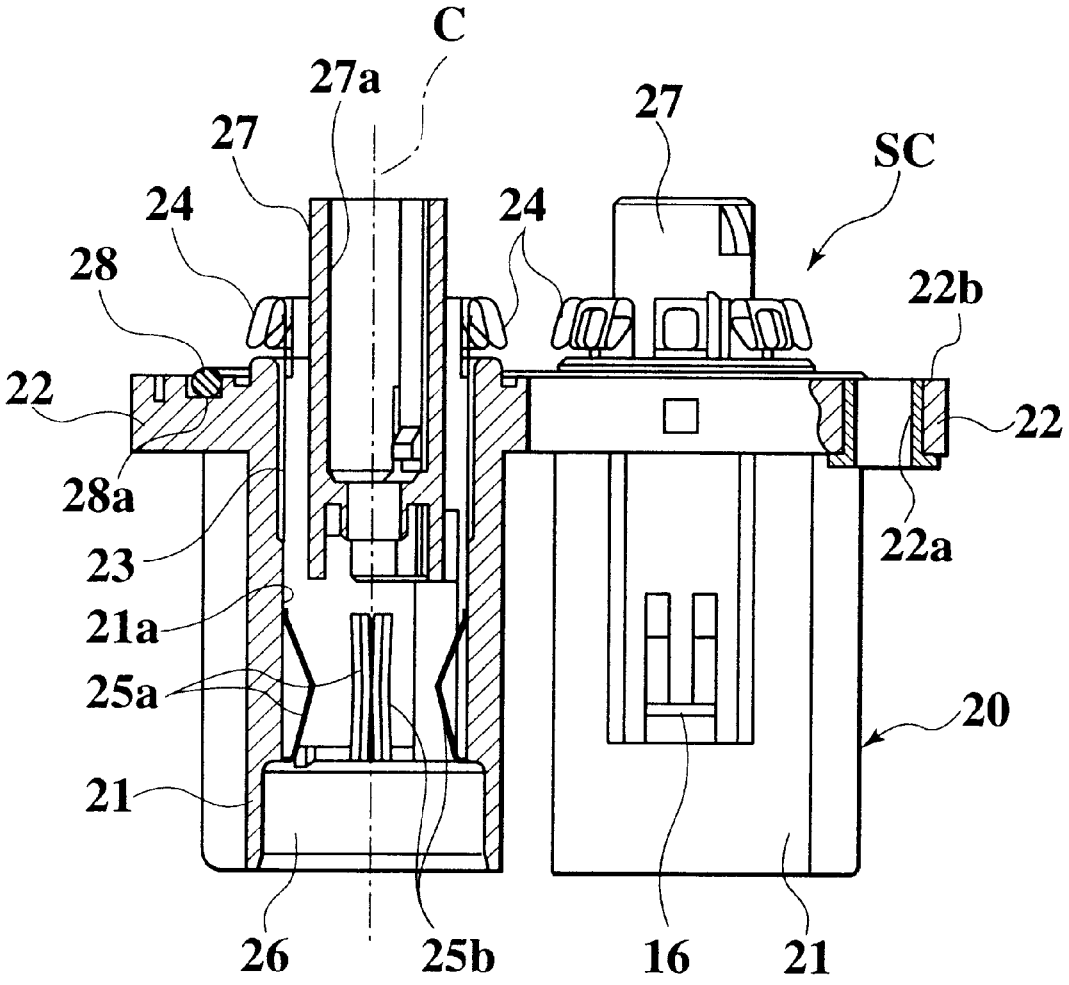
FIG. 2 is a sectional view taken along line II—II of FIG. 1A.
Figure 3:
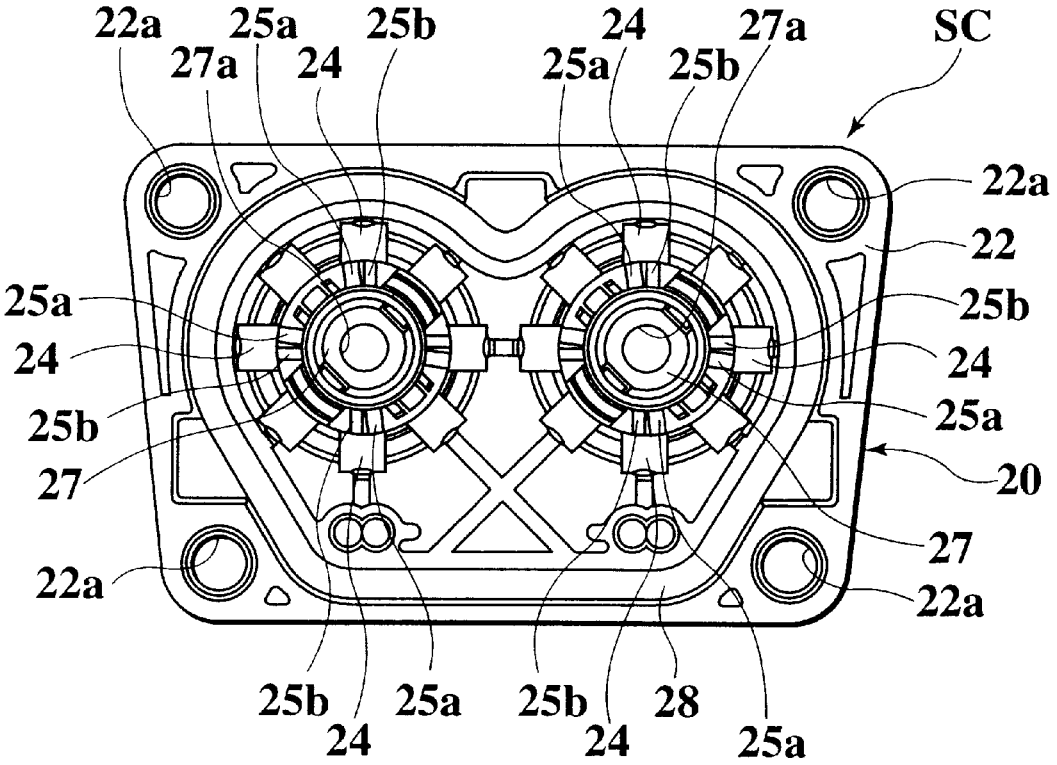
FIG. 3 is a rear view of the electro magnetic shield connector according to the second embodiment of the present invention.

FIG. 1A is a front view of an electro magnetic shield connector according to one embodiment of the present invention, and FIG. 1B is a sectional view taken along line IB—IB of FIG. 1A. FIG. 2 is a sectional view taken along line II—II of FIG. 1A, FIG. 3 is a rear view of the electro magnetic shield connector, FIG. 4 is a side view of the electro magnetic shield connector, and FIG. 5 is a front view of the electro magnetic shield connector.

Figure 11:
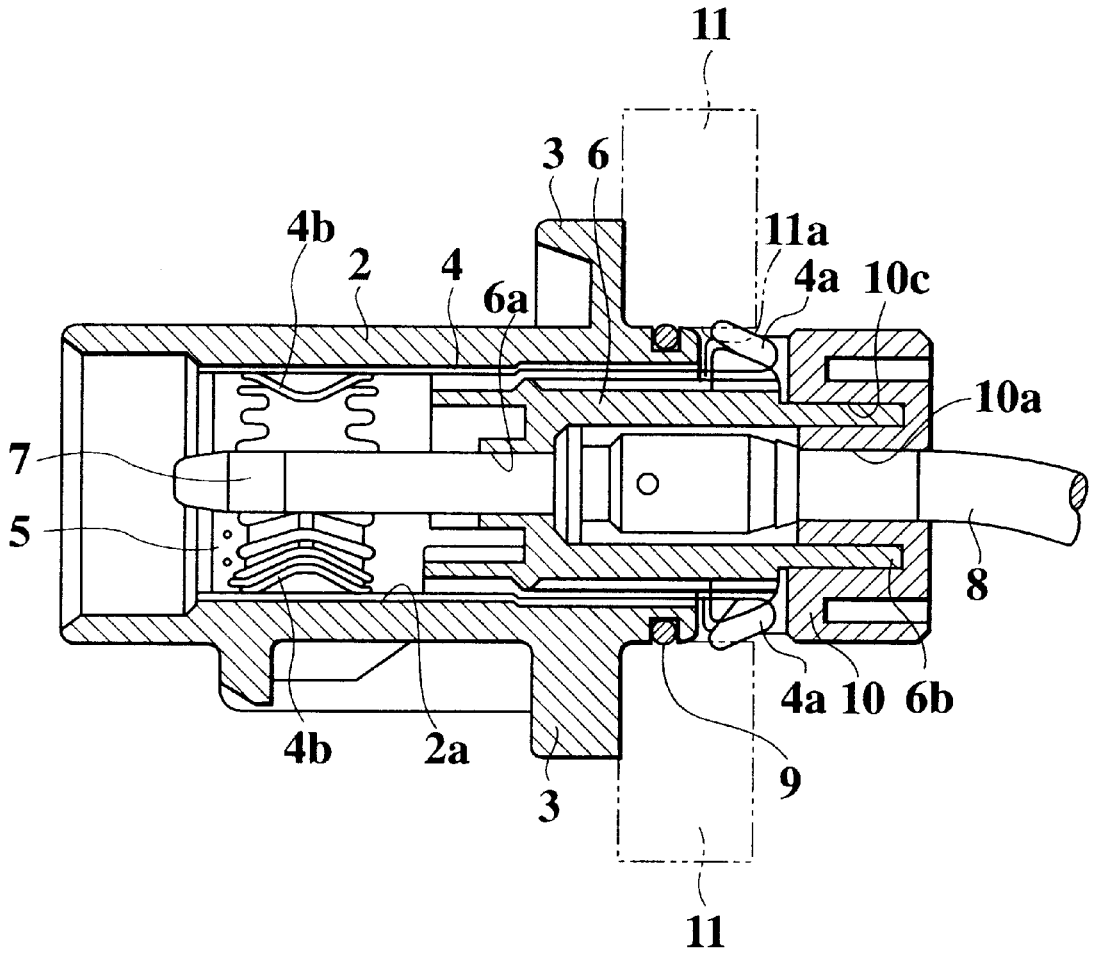
FIG. 11 is a sectional view taken along line XI—XI of FIG. 10.

In FIGS. 1A through 5, a basic structure of an electro magnetic shield connector SC is similar to that of the conventional one. Similarly, the connector 1 shown in FIGS. 11 and 12 is inserted into the connector insertion holes 11*a* of the case 11 made of conductive metal so as to be mounted to the case. A part of the description overlaps the relevant art, but the structure will be described roughly.

Namely, a resin-made connector main body 20 is composed integrally of twin connector housings 21 with a substantially cylindrical shape and a flange-shaped mounting seat section 22 for connecting the housings 21. Holes 21*a* which open on both surfaces are formed respectively in the connector housings 21 in their axial direction, and a shield shell 23 is arranged in the hole 21*a*.

Figure 4:
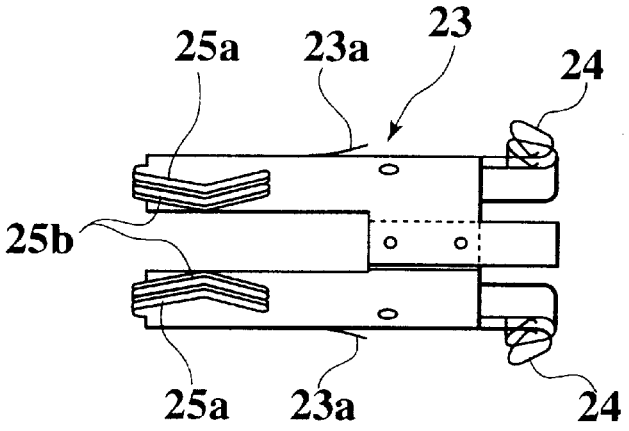
FIG. 4 is a side view of a shield shell.
Figure 5:
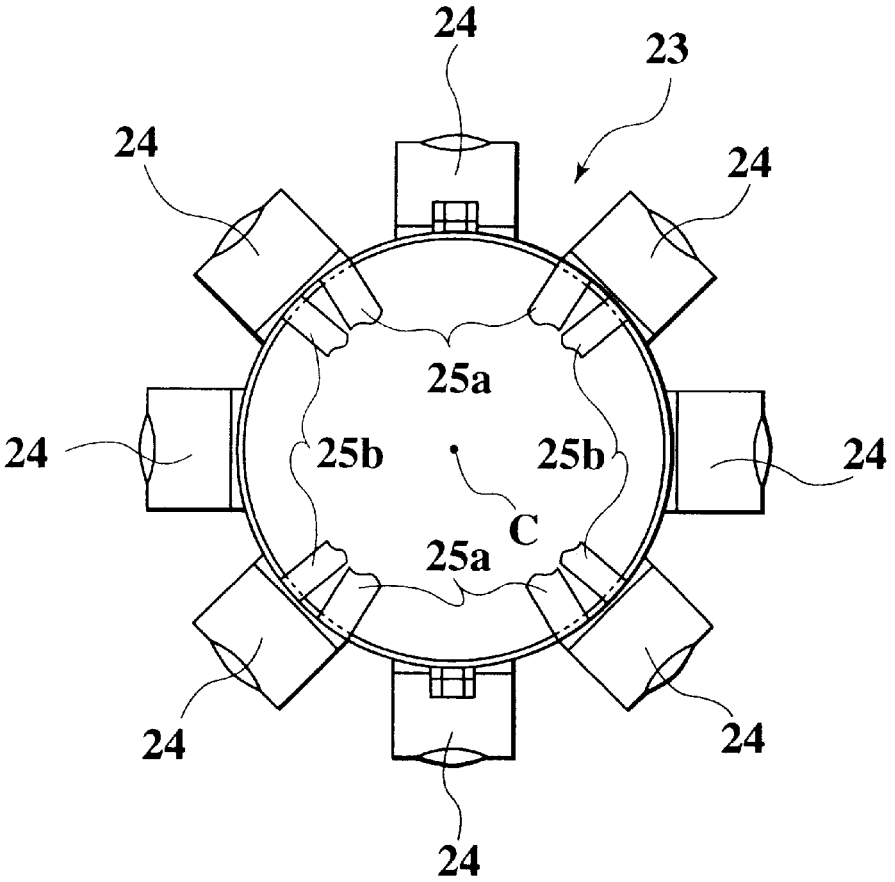
FIG. 5 is a front view of the shield shell.
Figure 6:
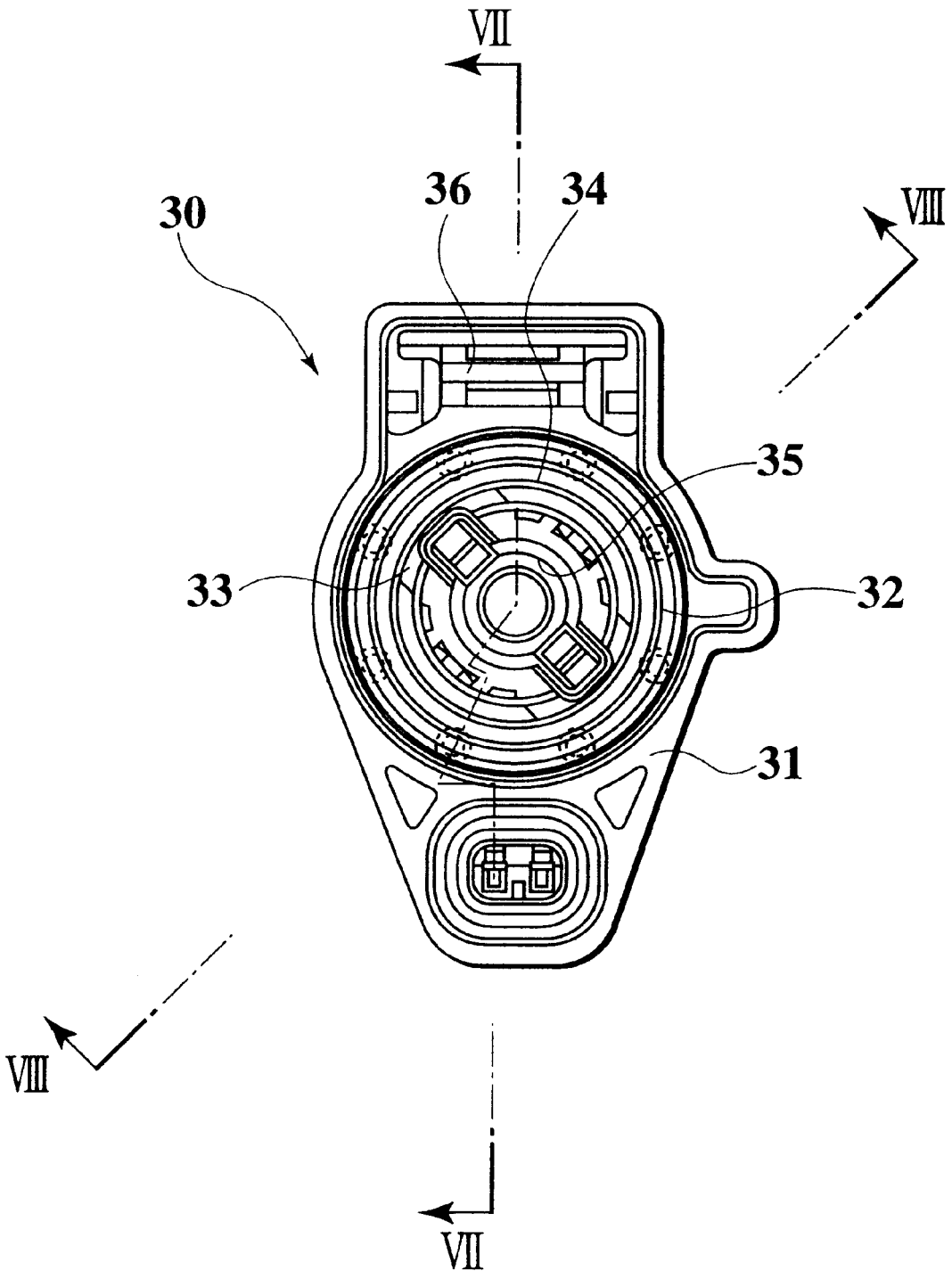
FIG. 6 is a front view of a mated connector according to one embodiment of the present invention.
Figure 7:
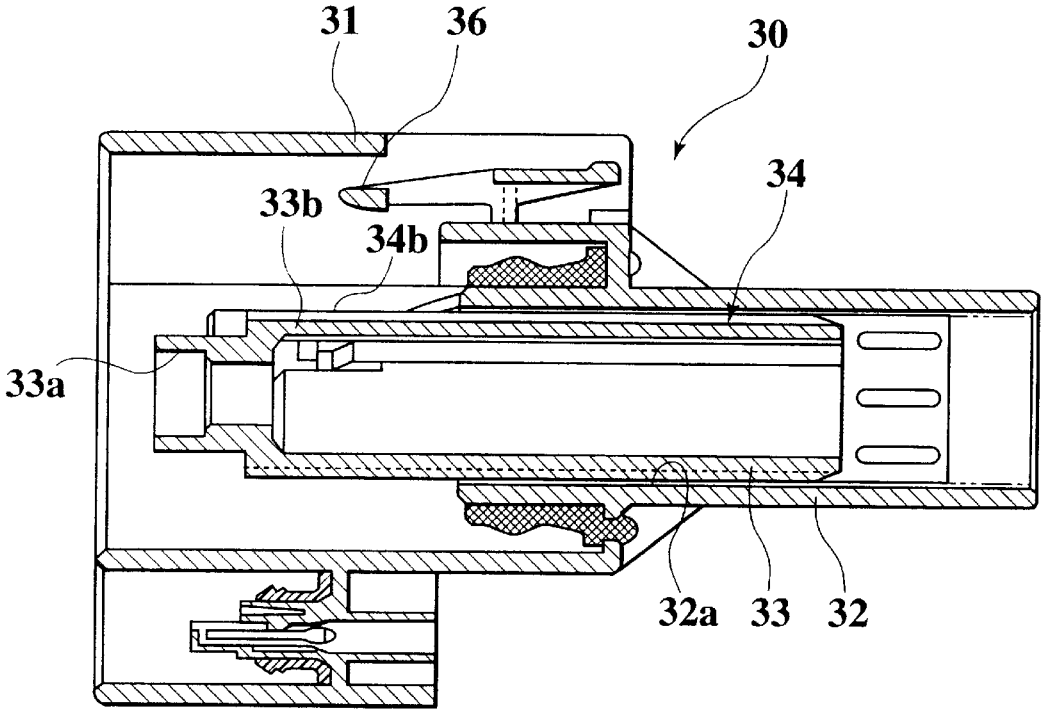
FIG. 7 is a sectional view taken along line VII—VII of FIG. 6.
Figure 8:
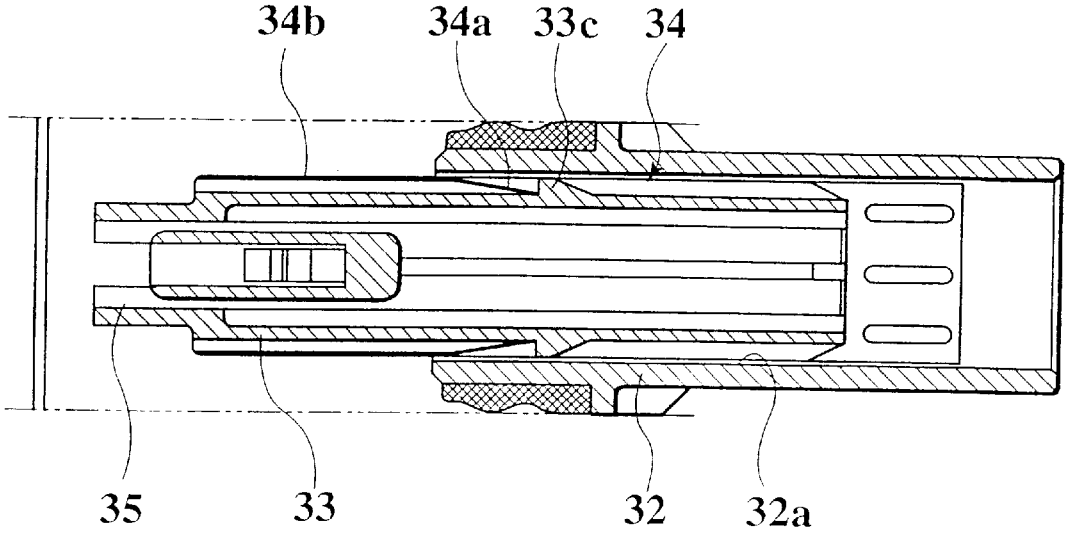
FIG. 8 is a sectional view taken along line VIII—VIII of FIG. 6.
Figure 9:
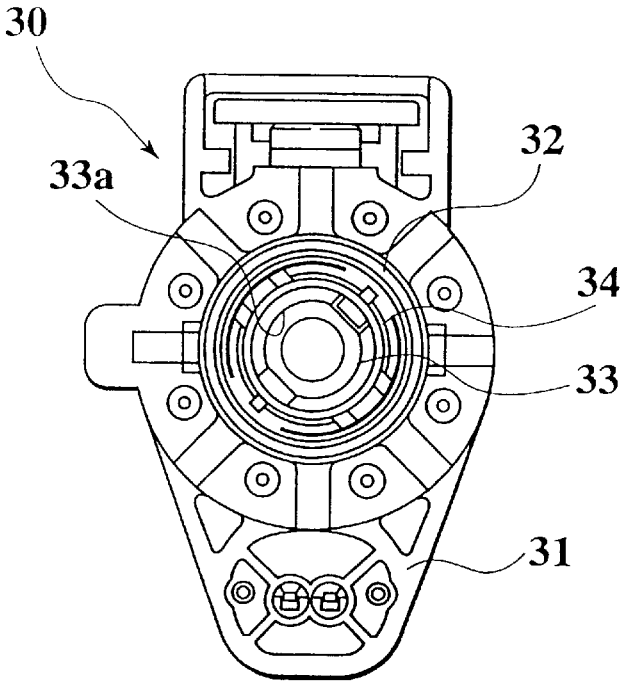
FIG. 9 is a rear view of the mated connector.
Figure 10:
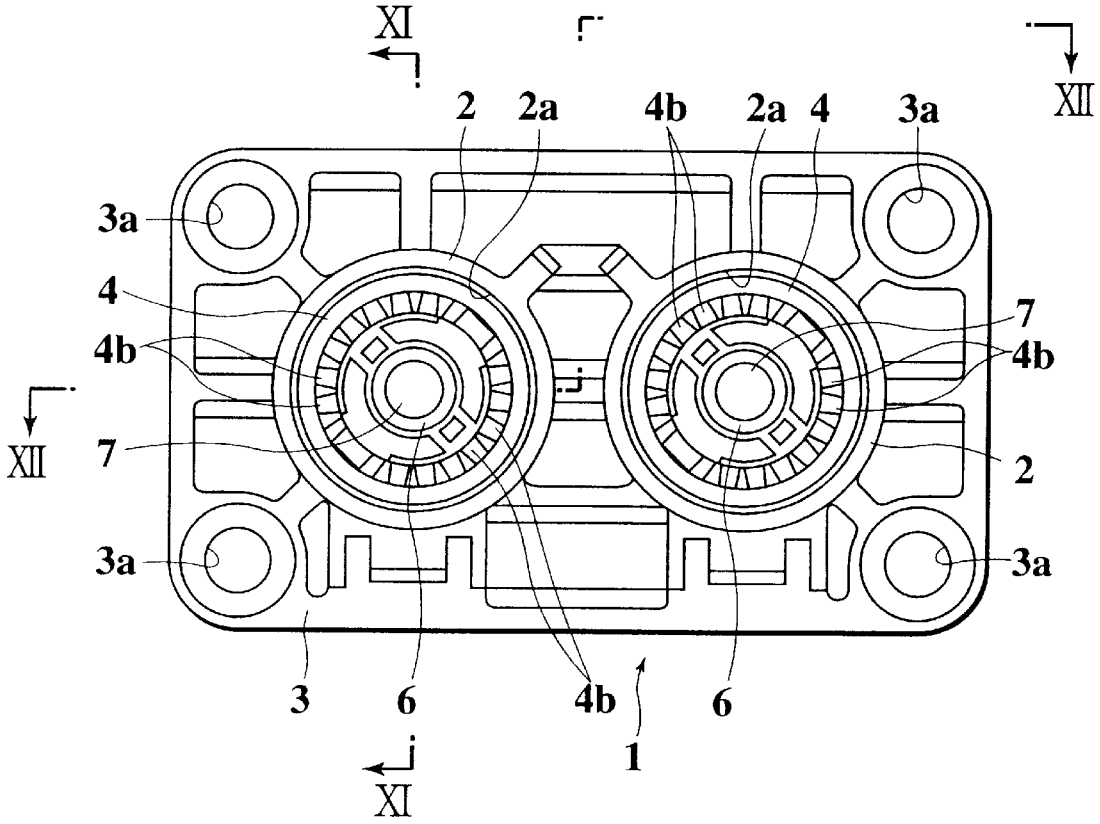
FIG. 10 is a front view of an electro magnetic shield connector according to a first embodiment of the present invention.

As detailed in FIGS. 4 and 5, the shield shell 23 is formed by conductive metal into an approximately cylindrical shape, and is arranged so as to come in contact with an inner surface of the hole 21*a*. Engagement pieces 23*a* (shown in FIG. 4) are projected from a center of the axial direction of the shield shell 23, and the shield shell 23 is fixed by spring forces of the engagement pieces 23*a* and by engaging the engagement pieces 23*a* with the connector housing 21. Moreover, a plurality of case contact pieces 24 are formed at one end of the shield shell 23 in a peripheral direction by bending, and the respective case contact pieces 24 are arranged so as to be projected outside from one end of the connector housing 21. A plurality of terminal contact spring pieces 25*a* and 25*b* are provided along the peripheral direction of an inner peripheral surface of the shield shell 23 at the other end. The plural terminal contact spring pieces 25*a* and 25*b* are composed of two types of wider pieces 25*a* and narrower pieces 25*b*. The wider pieces 25*a* are arranged so as to face each other across a center axis C of the cylindrical shape and the narrower pieces 25*b* are also arranged similarly. The other end of the hole 21*a* including the portions where the plural terminal contact spring pieces 25*a* and 25*b* are arranged is composed as a connector insertion chamber 26.

An inner housing member 27 has an approximately cylindrical shape and is fixed to the inner peripheral side of the shield shell 23 at one end side of the hole 21*a*. A hole 27*a* which opens on both the surfaces is formed the inner housing member 27 in an axial direction, and a pin terminal (male terminal), not shown, is mounted into the hole 27*a*. An insertion point of the pin terminal is arranged in a center position of the connector insertion chamber 26, and an insertion backward end of the pin terminal is connected with an end of a covered electric wire (not shown). Moreover, one end of the inner housing member 27 is projected further than the case contact pieces 24, and similarly to the conventional example, a holder (not shown) can be mounted to the projected portion.

Bolt insertion holes 22*a* are formed respectively in four corners of the mounting seat section 22, and similarly to the conventional example, when bolts (not shown), which are inserted through the bolt insertion holes 22*a*, are fitted into the case of the electrical equipment, the electro magnetic shield connector SC is fixed to the case. Seal grooves 28*a*, into which seal rings 28 as seal members are fitted, are provided on case contact surfaces 22*b* of the mounting seat section 22. Here, in FIGS. 1A and 2, a reference numeral 16 is a connector engagement section.

In FIGS. 6 through 9, a resin-made connector housing 31 of a mated connector 30 has a cylindrical section 32, and an inner housing 33 is provided in a hole 32*a* of the cylindrical section 32 in its axial direction. A shield shell 34 is arranged between the inner housing 33 and the cylindrical section 32. The shield shell 34 is formed by conductive metal into an approximately cylindrical shape, and is arranged so as to come in contact with an outer peripheral surface of the inner housing 33. Engagement pieces 34*a* are projected from a center of the shield shell 34 in the axial direction towards the inner peripheral side, and the shield shell 34 is fixed by spring force of the engagement pieces 34*a* and by engaging the engagement pieces 34*a* with engagement sections 33*c* of the inner housing 33.

One end of the inner housing 33 is projected further than the cylindrical section 32, and the projected portion is composed as an insertion section 33*b* into the electro magnetic shield connector SC. The shield shell 34 is extended onto the outer periphery of the insertion section 33*b*, and the extended portion becomes a shield extended section 34*b*. Further, a terminal insertion hole 33*a* is formed on the inner housing 33 in the axial direction, and a female terminal 35 is provided in the terminal insertion hole 3*a*. Here, in FIGS. 6 and 7, a reference numeral 36 is a connector engagement section. Moreover, a shield electric wire, not shown, is mounted to the inner housing 33 via a shield terminal, not shown.

There will be described below the connector mounting operation. The mated connector 30 is brought closer to the electro magnetic shield connector SC fixed to the case, and the insertion section 33*b* of the connector housing 31 is inserted into the connector insertion chamber 26 of the electro magnetic shield connector SC. Then, in this insertion step, the terminal contact spring pieces 25*a* and 25*b* of the shield shell 23 of the electro magnetic shield connector SC are elastically deformed in a diameter-enlarged direction so that the shield extended section 34*b* of the shield shell 34 of the mated electro magnetic shield connector 30 is allowed to be inserted. Moreover, the pin terminal is inserted into the female terminal 35. As a result, the plural terminal contact spring pieces 25*a* and 25*b* are electrically connected with the shield extended section 34*b* of the shield shell 34, and the pin terminal is electrically connected with the female terminal 35.

Here, the diameter of the insertion section 33*b* of the mated connector 30 scatters, and thus the insertion section

33*b* which has a diameter larger than a normal diameter is occasionally inserted. However, the terminal contact spring pieces 25*a* and 25*b* are composed of the wider pieces 25*a* and narrower pieces 25*b*, and their allowable stresses are different. For this reason, even if the wider terminal contact spring pieces 25*a* function defectively due to excessive displacement, the narrower terminal contact spring piece 25*b* have a larger allowable displacement and thus does not function defectively. As a result, faulty contact does not occur.

In addition, the wider terminal contact spring pieces 25*a* are arranged in counter positions in the cylindrical shape, and the narrower terminal contact spring pieces 25*b* are arranged similarly. As a result, spring forces are applied to the insertion section 33*b* of the mated connector 30 in a balanced state, and thus the insertion operation can be performed in the normal insertion position smoothly and easily.

Further, the case contact pieces 24 are provided to the shield shell 23, and when the connector housing 21 is inserted into the connector insertion hole of the case, the case contact pieces 24 come in contact with the inner surface of the case insertion hole by their elastic deformation. As a result, even if the mounting seat section 22 is deformed by a heat, the shield shell 23 can be electrically connected with the case securely.

In addition, since the seal ring 28 is provided on a surface of the bolt in a fastening direction, the seal ring 28 intervenes between the electro magnetic shield connector SC and the case due to the fastening force of the bolt. As a result, waterproofness becomes very high.

The entire contents of Japanese Patent Application P10-264879 (filed Sep. 18, 1998) are incorporated herein by reference.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

What is claimed is:

1. An electro magnetic shield connector, comprising:

a connector housing to be mounted to a case of an electrical equipment, a connector insertion chamber being formed inside the connector housing, the case of the electrical equipment having a connector insertion hole formed thereon;

a shield shell provided in the connector insertion chamber of the connector housing, the shield shell having a plurality of terminal contact spring pieces and case contact pieces, the case contact pieces being elastically deformed so as to come in contact with an inner surface of the connector insertion hole when the connector housing is inserted into the connector insertion hole;

a mated connector housing having an insertion section to be inserted into the connector insertion chamber; and another shield shell provided in the mated connector housing;

wherein when the insertion section of the mated connector housing is inserted into the connector insertion chamber of the connector housing, the terminal contact spring pieces of the shield shell are elastically deformed so as to come in contact with the another shield shell provided in the mated connector housing; and wherein the plural terminal contact spring pieces are composed of plural wider terminal contact spring pieces and plural narrower terminal contact spring pieces, the plural wider and narrower terminal contact spring pieces having different allowable stresses to prevent a faulty contact with the another shield shell.

2. An electro magnetic shield connector according to claim 1, wherein the shield shell is formed into a cylindrical shape;

wherein the plural terminal contact spring pieces are provided on a peripheral direction of the cylindrical shape of the shield shell;

wherein the plural wider terminal contact spring pieces are arranged on a cylindrical portion of the shield shell so as to face each other; and wherein the plural narrower terminal contact spring pieces are arranged on the cylindrical portion of the shield shell so as to face each other.

3. An electro magnetic shield connector according to claim 1, further comprising:

a mounting seat section which is composed integrally with the connector housing, the mounting seat section has a flange shape, the mounting seat section having a case contact surface to come in contact with the case of the electrical equipment, wherein bolt insertion through holes, into which bolts are inserted in order to mount the connector housing to the case of the electrical equipment, are formed in the mounting seat section;

wherein a seal groove, in which a sealing member for sealing the case of the electrical equipment and the case contact surface is inserted, is formed on the case contact surface of the mounting seat section; and wherein the bolts are inserted through the bolt insertion through holes and the mounting seat section is fastened to the case of the electrical equipment so that the sealing member seals the case of the electrical equipment and the case contact surface.

4. An electro magnetic shield connector according to claim 2, further comprising:

a mounting seat section which is composed integrally with the connector housing, the mounting seat section has a flange shape, the mounting seat section having a case contact surface to come in contact with the case of the electrical equipment, wherein bolt insertion through holes, into which bolts are inserted in order to mount the connector housing to the case of the electrical equipment, are formed in the mounting seat section;

wherein a seal groove, in which a sealing member for sealing the case of the electrical equipment and the case contact surface is inserted, is formed on the case contact surface of the mounting seat section; and wherein the bolts are inserted through the bolt insertion through holes and the mounting seat section is fastened to the case of the electrical equipment so that the sealing member seals the case of the electrical equipment and the case contact surface.

* * * * *